United States Patent [19]

Rausch et al.

[11] Patent Number: 4,526,817

[45] Date of Patent: Jul. 2, 1985

[54] PROCESS FOR SURFACE DIFFUSING STEEL PRODUCTS IN COIL FORM

[75] Inventors: John J. Rausch, 18715 W. Edward Rd., Antioch, Ill. 60002; Russell F. Novy, Northbrook, Ill.

[73] Assignees: Material Sciences Corporation, Elk Grove Village; Ray J. Van Thyne, Inverness; John J. Rausch, Gurnee, all of Ill.

[21] Appl. No.: 538,789

[22] Filed: Oct. 4, 1983

Related U.S. Application Data

[63] Continuation-in-part of Ser. No. 438,161, Nov. 1, 1982, abandoned.

[51] Int. Cl.[3] ..... C23C 1/00

[52] U.S. Cl. ..... 427/431; 427/383.9; 428/667

[58] Field of Search ..... 427/431, 383.9

[56] References Cited

U.S. PATENT DOCUMENTS

| | | | |
|---|---|---|---|
| 2,399,848 | 5/1946 | Becker et al. . | |
| 2,415,078 | 2/1947 | Becker | 427/431 |
| 2,685,543 | 11/1983 | Sindeband | 427/431 |
| 3,184,330 | 5/1965 | Carter . | |
| 3,184,331 | 5/1965 | Carter . | |
| 3,216,106 | 11/1965 | Daubersy . | |
| 3,261,712 | 7/1966 | Carter . | |
| 3,377,195 | 4/1968 | Sneesby . | |
| 3,377,196 | 4/1968 | Sneesby . | |
| 3,397,078 | 8/1968 | Anserson . | |
| 3,467,545 | 9/1969 | Carter . | |
| 3,481,769 | 12/1969 | Carter . | |
| 3,620,816 | 11/1971 | Rausch | 427/431 |
| 3,745,110 | 7/1973 | Allred . | |
| 3,787,228 | 1/1974 | Rausch et al. . | |
| 3,795,537 | 3/1974 | Van Thyne et al. . | |
| 4,081,575 | 3/1978 | Spirig . | |
| 4,153,742 | 5/1979 | Boehn et al. . | |
| 4,168,333 | 9/1979 | Rausch et al. . | |

FOREIGN PATENT DOCUMENTS

| | | | |
|---|---|---|---|
| 704619 | 3/1965 | Canada . | |
| 50-10695 | 4/1975 | Japan | 427/383.9 |

*Primary Examiner*—Sam Silverberg
*Attorney, Agent, or Firm*—Emrich & Dithmar

[57] ABSTRACT

Steel product in coil form such as sheet steel is uncoiled, then preheated, continuously transported through a lead bath containing chromium, then cooled, and finally recoiled. When the coiled steel does not have titanium, titanium is included in the bath in order to improve the corrosion resistance of the final product.

10 Claims, 7 Drawing Figures

10
12
12
30
31
32
33
34
35
36
37
38
39
43
44
45
46
50
51
51
60
61
62
63
64
64
66
68
68
70
70
71
72
72
24
25
26
80
81a
81b
81c
82
85
86a
86b
86c
87
89
89
89
90
91
91
92
93
100
102
103
104
104
152
152
170

PROCESS FOR SURFACE DIFFUSING STEEL PRODUCTS IN COIL FORM

REFERENCE TO RELATED APPLICATION

This application is a continuation-in-part of application Ser. No. 438,161, filed Nov. 1, 1982, for "Process and Apparatus for Surface Diffusing Steel Product in Coil Form and the Products Made by Such Process and Apparatus", now abandoned.

BACKGROUND OF THE INVENTION

U.S. Pat. Nos. 3,620,816 and 4,168,333 describe methods for diffusing elements such as chromium and/or aluminum into the surface of ferrous-based substrates in order to produce an alloyed steel surface. Such methods involve placing the substrate in a molten lead bath containing chromium and/or aluminum for an extended period of time, from one to eighteen hours. The molten lead acts as a transfer agent to transfer the chromium and/or aluminum dissolved in the bath to the substrate and to diffuse the same into its surfaces. Processing times of one hour or more are satisfactory when batch processing is employed; in other words, when the parts are placed in a bath for the requisite time and then removed. Such long periods of time, however, are not satisfactory when it is desired to diffuse chromium and/or aluminum into the surfaces of steel sheet or other products, in coil form, on a continuous basis.

The carbon in the steel while important to giving steel its strength, adversely affects the corrosion resistance of a chromium diffusion layer formed on the surface of the steel. Low carbon steel having a carbon content of between 0.01% and 0.06% by weight is available. Various decarburization heat treatments can reduce the carbon content still further. However, as the chromium diffuses into the surface of such low carbon, decarburized steel, the remaining carbon tends to migrate to the surface. It is believed that when sufficient carbon has diffused into the chromium diffusion alloy layer on the steel, precipitation of chromium carbides will occur during subsequent cooling from the processing temperature, which can result in chromium depletion in regions adjacent to the carbides. This effect is believed to cause the loss in corrosion resistance. Therefore, it is desirable to form the carbon adjacent the surfaces of the ferrous-based material into carbides that are more stable than chromium carbides.

In preparing the bath for performing the diffusing process, chromium is added thereto. Usually chromium is in particulate form and is contained within a cage that is placed in the bath. The cage is normally agitated, causing the chromium particles to dissolve in the molten lead and thereby leave the cage. The chromium is either in elemental form or is an alloy such as ferrochromium. Either form is likely to have debris associated therewith. The debris does not dissolve in the bath and instead travels upwardly in the bath to form a dross on its surface. When sheet steel is drawn through such a bath, it tends to pick up impurities from the dross, Which impurities constitute barriers to diffusion of the chromium. Furthermore, these inorganic particles serve as nucleation sites for the in-situ growth of dendritic structures of alloy crystals that form on the surface. The corrosion resistance of the steel at the sites of the foreign matter is much less. The contamination can be reduced by screening the chromium prior to its being placed in the bath. Additionally, the chromium can be cleaned with chemicals such as solvents and acids.

SUMMARY OF THE INVENTION

It is therefore an important object of the present invention to provide a process, and apparatus for practicing the process, to continuously diffuse elements such as chromium and/or aluminum into the surfaces of steel sheet and other products in coil form.

Another object in connection with the foregoing object is to uncoil the coiled steel, pass it through a molten alloy bath within minutes or even less than one minute, and generate steel product with stainless steel surfaces that are highly corrosion resistant.

Another object is to utilize low-carbon coiled steel, uncoil it, decarburize it and finally form whatever carbon is remaining adjacent the surfaces into carbides more stable than chromium carbides, so as to improve the corrosion resistance of the steel product.

Another object in connection with the foregoing object is to diffuse titanium into the surfaces of the uncoiled steel, ahead of the diffusing chromium.

It is another object of the present invention to utilize coiled steel products, uncoil them, and treat the uncoiled steel in a molten lead bath in such a way that foreign matter in the dross associated with the bath does not attach itself to the steel as it enters and exits the bath.

Another object is to provide sheet steel with a thin chromium alloy layer diffused into each surface.

In summary, there is provided a continuous process of surface diffusion alloying a continuous length of steel product supplied in a coil, comprising uncoiling the steel product, preheating the steel product, providing a molten-alloy bath having therein lead and chromium and titanium, the molten-alloy bath having titanium of a concentration in the range of about 67 ppm to about 367 ppm, lead being the only transfer agent in the bath, moving the steel product continuously through the bath for diffusing the chromium into the surface of the steel product, and cooling the diffused steel product.

The invention consists of certain novel features, a composition of matter and a process and apparatus for making such composition of matter, as hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
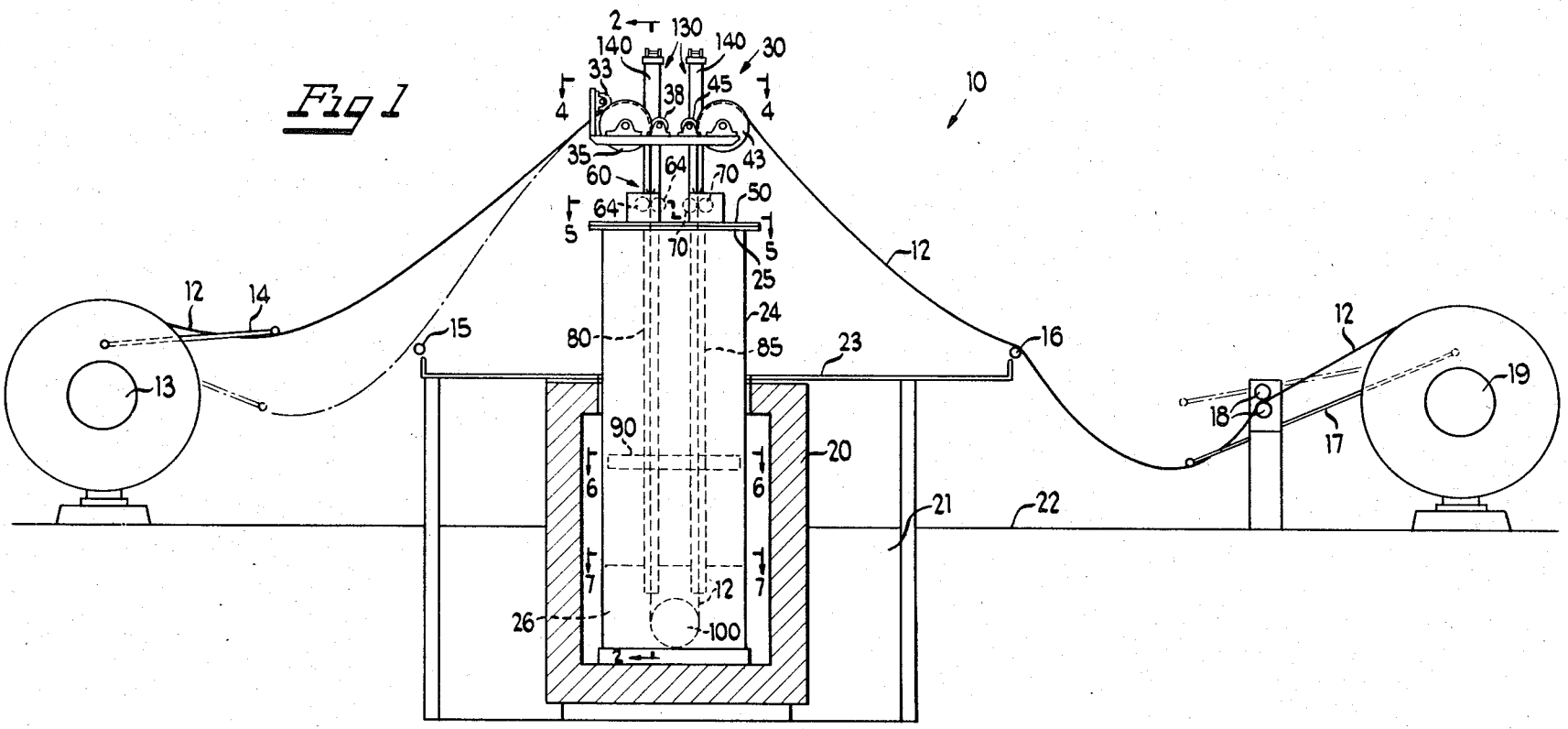
FIG. 1 is a somewhat schematic, elevational view of apparatus for continuously diffusing chromium or other element into the surface of sheet steel.

Turning to the drawings and more particularly to FIG. 1 thereof, there is depicted a processing apparatus generally designated by the number 10, which is operative to continually diffuse chromium into the surfaces of sheet steel. The present invention is described in connection with diffusion of chromium to obtain stainless steel surfaces on the sheet steel. However, the principles of the invention are applicable to other steel products in coiled form such as foil (having a thickness of less than 12 mils), plate and wire. While chromium is the preferred diffusing element, and will be so described, additional and/or other diffusing elements can be employed. For example, aluminum can be diffused along with or instead of chromium. The processing apparatus 10 represents a model of a line to produce chromized sheet steel on a continuous basis. It is a model in that the steel to be processed is narrow on the order of about four inches. In actual practice, steel two or three feet in width or more can be processed.

The sheet steel 12 is supplied in coil form, wrapped around a hub 13 mounted for rotation in known manner. A motor (not shown) rotates the hub 13 to unroll the sheet steel. The sheet steel 12 passes a follower arm 14 which operates a switch (not shown) that controls the motor. When the motor is on, sheet steel 12 is withdrawn from the roll to increase the size of the loop as shown by the phantom line, until the follower arm 14 reaches the position indicated in phantom, whereupon the motor is turned off. The sheet steel, being drawn by a subsequent station by a drive mechanism to be described, straightens the loop. In this way, the size of the loop is controlled.

The sheet steel 12 passes a deflector roll 15 to equipment located in a furnace 20 in turn positioned within a pit 21 located beneath the floor 22. An access platform 23 is located above the furnace 20. Removably positioned in the furnace 20 is a cylindrical retort 24 closed at the bottom and having a flange 25 extending around its periphery at the top. The retort 24 contains a predetermined quantity of molten lead 26.

The processing apparatus 10 comprises a drive mechanism 30 which includes a hold-down or pressure roll 33 bearing against a flanged idler roll 35. The sheet steel 12 passes between the rolls 33 and 35, and around the roll 35, and in between it and a brake roll 38. The sheet steel 12 is drawn downwardly through rolls 64 of a sealing mechanism 60, through a rectangular inlet tube 80 into the retort 24. The sheet steel 12 passes into molten lead 26, around the idler roll mechanism 100, up through a rectangular outlet tube 85. The exiting sheet steel 12 passes through another pair of rolls 70 in the sealing mechanism 60 and then up between a drive roll 45 and a flanged idler roll 43. The drive roll 45 is rotated by a motor, in a manner to be described, which pulls the sheet steel 12 from the coil so as to follow the path just described. The sheet steel 12 passes over a deflection roll 16, an output follower arm 17, between tension rolls 18 and onto a hub 19 to form an output coil. The hub 19 is also connected to a motor (not shown) which is energized by a switch (not shown) controlled by the follower arm 17. The phantom line position of the follower arm 17 indicates its position when the motor is energized to remove the loop.

Figure 3:
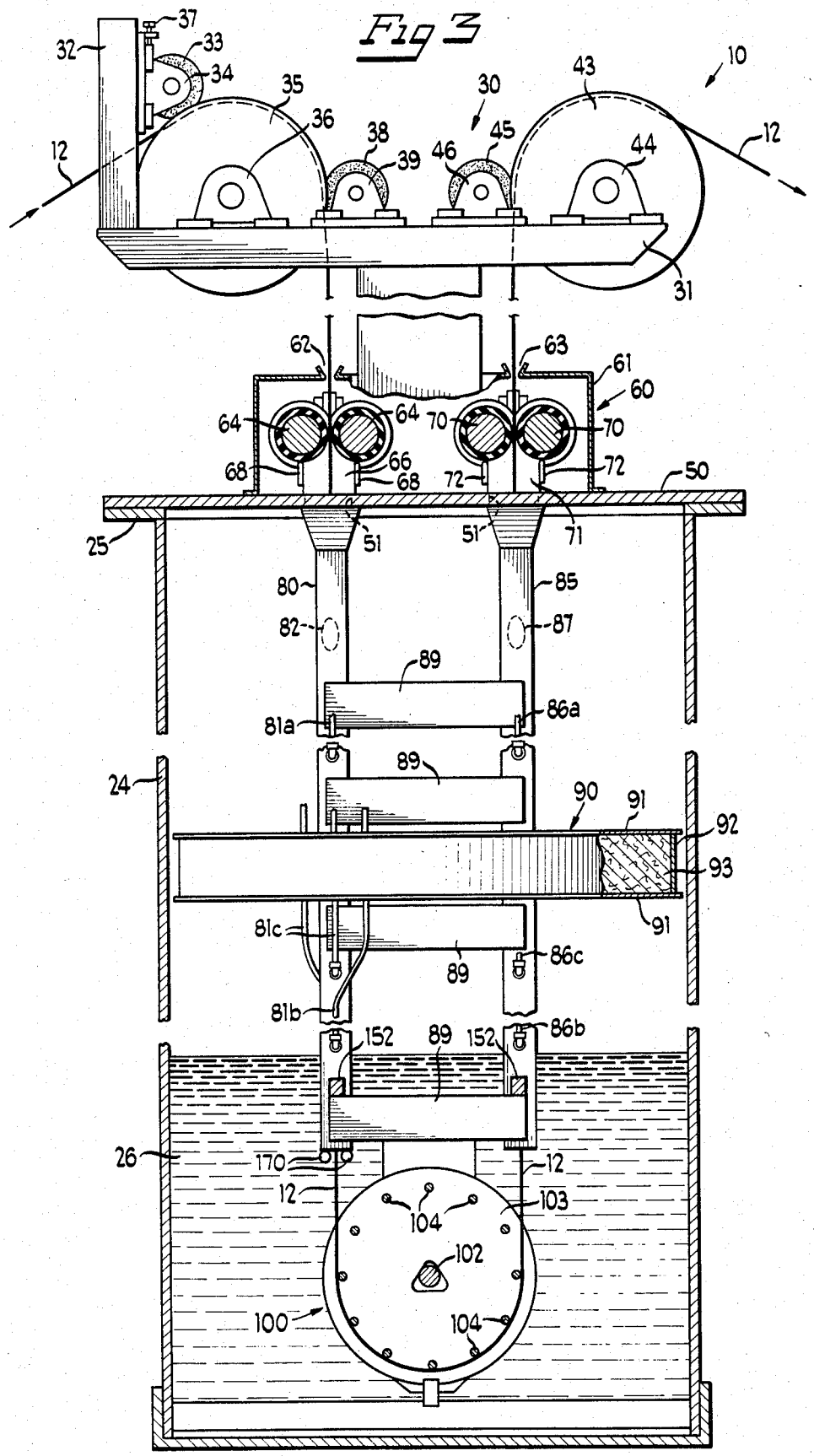
FIG. 3 is a fragmentary view in vertical section taken along the line 3—3 of FIG. 2.
Figure 4:
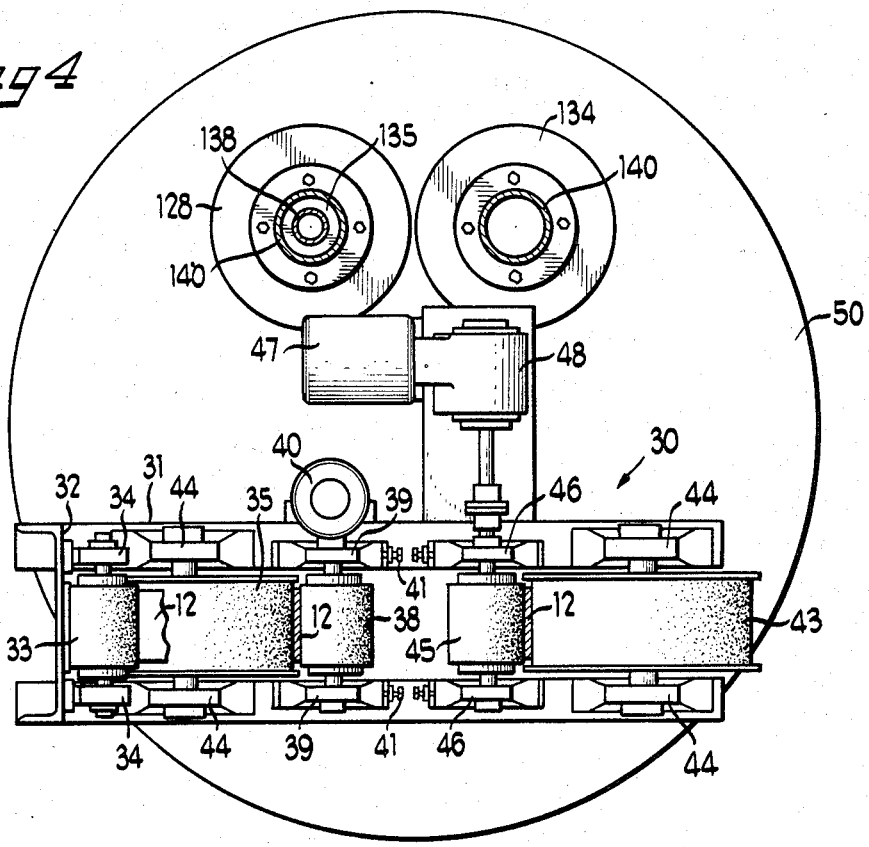
FIG. 4 is a view in horizontal section on an enlarged scale taken along the line 4—4 of FIG. 1.

Turning now to FIGS. 3 and 4, further details of the drive mechanism 30 will be described. The drive mechanism 30 includes a generally horizontally oriented frame 31 having at one end an upstanding portion 32. A hold-down or pressure roll 33 is journaled into pillow blocks 34 which are mounted on the upstanding portion 32. A flanged idler roll 35 is journaled into pillow blocks 36 carried by the frame 31. The roll 33 is biased against the roll 35. Adjusting screws 37 positioned in operative relationship with the pillow blocks 34 enable movement of the roll 33. The sheet steel 12 passes between the rolls 33 and 35 each of which has a deformable rubber surface. The adjustment screws 37 are used to control the pressure on the sheet steel 12. The sheet steel 12 remains in contact with the roll 35 for 120° or so. A brake roll 38 is journaled into pillow blocks 39 mounted on the frame 31. The brake roll 38 has a deformable rubber surface biased against the roll 35. The shaft of the roll 38 is connected to a brake 40 which is adjustable to control the friction or braking of the roll 38 as the sheet steel 12 moves therebetween, which in turn controls the tension in that part of the sheet steel 12 between the input and output stages of the drive mechanism 30.

After passing through the retort 24, the sheet steel 12 returns to the drive mechanism 30. The drive mechanism 30 further includes an output roll 43 journaled into pillow blocks 44 carried by the frame 31. A smaller, drive roll 45 is journaled into pillow blocks 46 which are mounted on the frame 31. The rolls 43 and 45 have deformable rubber coatings and the sheet steel 12 passes therebetween. The shaft of the roll 45 is connected to a motor 47 by way of a gear box 48. The drive roll 45 rotates to draw sheet steel 12 from the coiled source thereof, through the retort 24. From there the sheet steel 12 is drawn onto the hub 19 as previously explained.

Figure 2:
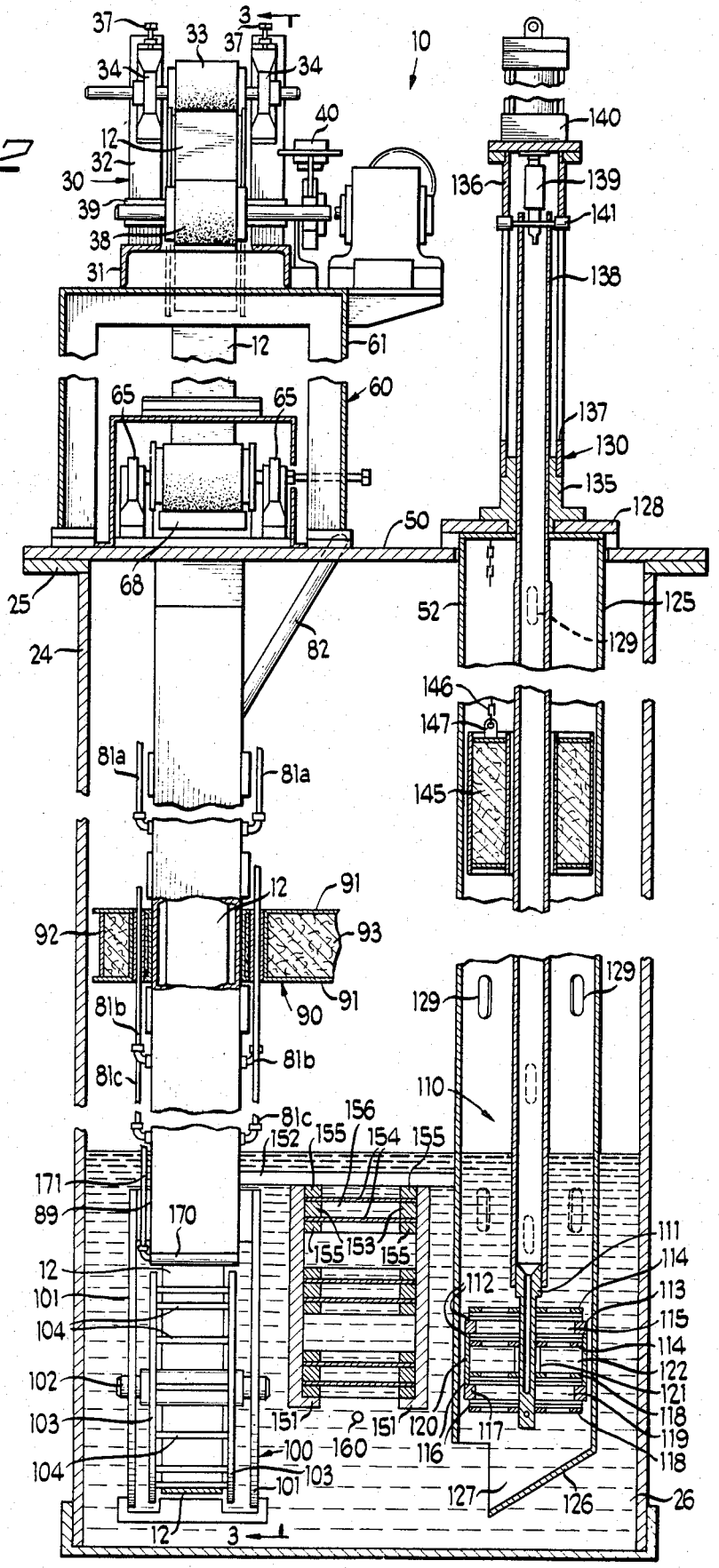
FIG. 2 is a fragmentary view in vertical section on an enlarged scale taken along the line 2—2 of FIG. 1.
Figure 5:
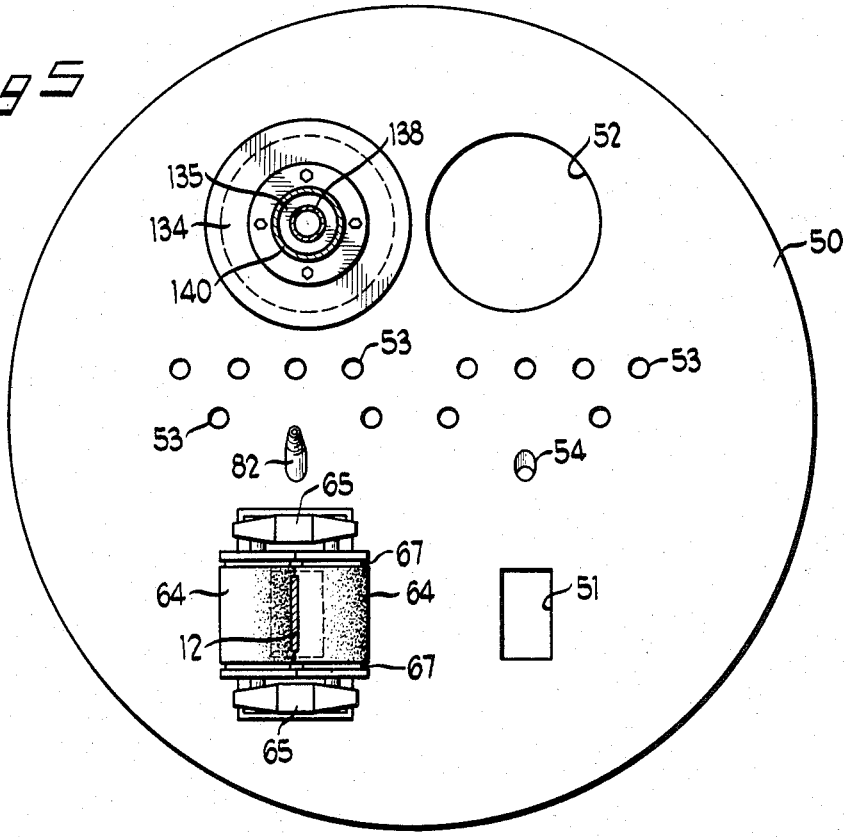
FIG. 5 is a view in horizontal section on an enlarged scale taken along the line 5—5 of FIG. 1.
Figure 6:
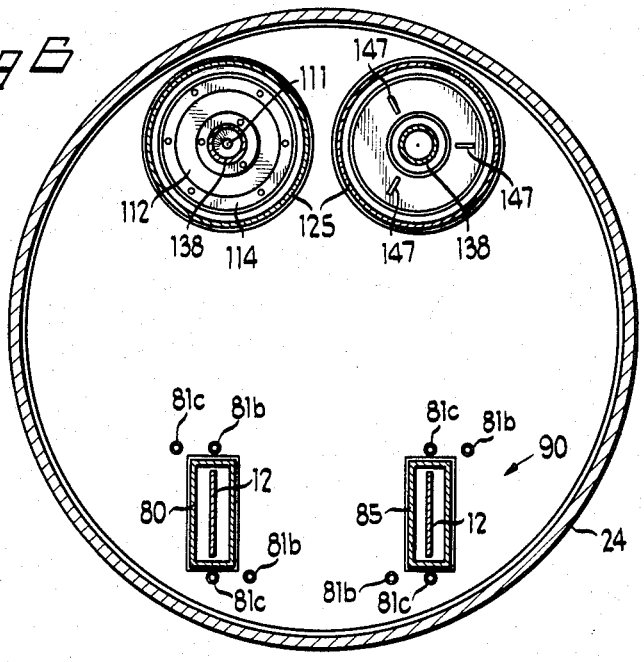
FIG. 6 is a view in horizontal section on an enlarged scale taken along the line 6—6 of FIG. 1.

Turning to FIGS. 2, 3 and 5, the apparatus 10 further comprises a cover plate 50 welded to the flange 25 of the retort 24. The cover plate 50 has a pair of spaced-apart rectangular openings 51 and a pair of spaced-apart round openings 52. Ports 53 in the plate 50 accommodate protective atmosphere flow into the interior of the retort 24. The cover plate 50 also has a pair of spaced-apart exhaust-pipe openings 54 for purposes to be described.

The sealing mechanism 60 includes a rectangular housing 61 formed of sheet metal and having a rectangular inlet slit 62 and rectangular outlet slit 63. Aligned with the inlet slit 62 is a pair of inlet rolls 64 biased against each other and respectively journaled into opposed pillow blocks 65. Located at the ends of the rolls 64 are two side sealing plates 66, each having a pair of concave upper surfaces that fit into grooves 67 in the ends of the rolls 64. End sealing plates 68 have their upper ends bearing against the bottoms of the rolls 64. The sheet steel 12 passes between the rolls 64 and into the retort 24. The plates 66 and 68 in conjunction with the roll 64 constitute a mechanical seal to preclude leakage of the atmosphere in the tube 80. Similarly, the sealing mechanism 60 includes a pair of outlet rolls 70 aligned with the inlet slit 62. The rolls 70 are biased against each other and respectively are journaled into opposed pillow blocks (not shown). Located at the ends of the rolls 70 are two side sealing plates 71, each having a pair of concave upper surfaces that fit into grooves in the ends of the rolls 70. End sealing plates 72 have their upper ends bearing against the bottoms of the rolls 70. The sheet steel 12 passes between the rolls 70 as it exits the retort 24. The plates 71 and 72 in conjunction with the roll 70 constitute a mechanical seal to preclude leakage of the atmosphere in the tube 85.

The rectangular tube 80 has a flared upper end welded to the underside of the cover plate 50 and communicates with one opening 51 in the plate 50 and is aligned with the sealing rolls 64. A pair of inlet pipes 81*a* is attached to upper points on the tube 80, a pair of inlet pipes 81*b* is attached to lower points on the tube 80 just above the level of the lead 26, and a pair of inlet pipes 81*c* is attached to intermediate points. The pipes 81*a, b* and *c* enable selected gases to be delivered to the interior of the tube 80. Any one or more of such pipes may be utilized to deliver the gases to a selected point or points in the tube 80. Although not shown, the pipes 81*a–c* extend through the cover 50 to enable connection to the gas sources. An exhaust pipe 82 is attached to the tube 80 and extends through the cover 50, and enables gases in the tube 85 to be exhausted into the environment. The rectangular tube 85 has a flared upper end welded to the underside of the cover plate 50 and the tube 85 communicates with the other opening 51 in the plate 50 and is aligned with the sealing rolls 70. A pair of inlet pipes 86*a* is attached to upper points on the tube 85, a pair of inlet pipes 86*b* is attached to lower points on the tube 85 just above the level of the lead 26, and a pair of pipes 86*c* is attached to intermediate points. The pipes 86*a, b* and *c* enable selected gases to be delivered to the interior of the tube 85. Any one or more of such pipes may be utilized to deliver the gases to a selected point or points in the tube 85. Although now shown, the pipes 86*a–c* extend through the cover 50 to enable connection to the gas sources. An exhaust pipe 87 is attached to the tube 85 and extends through the cover 50, and enables gases in the tube 85 to be exhausted into the environment. Four cross braces 89 are attached to the tubes 80 and 85.

The sheet steel 12 passes through the tube 80, down into the molten lead bath 26 and after it is processed, is directed back up through the tube 85 and into the sealing mechanism 60.

The insulation plug 90 includes top and bottom plates 91, an annular side wall 92 and insulation material 93. The tubes 80 and 85 pass through the insulation plug 90 and are welded thereto. The insulation plug 90 reduces heat loss from the bath 26.

Figure 7:
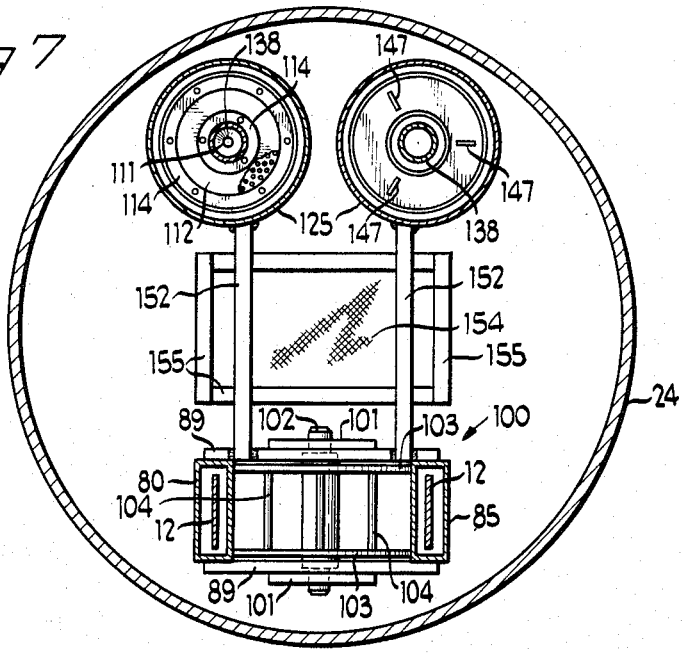
FIG. 7 is a view in horizontal section on an enlarged scale taken along the line 7—7 of FIG. 1.

The idler roll mechanism 100 is depicted in FIGS. 2, 3 and 7. It includes a pair of straps 101 depending from the lowermost cross brace 89. A shaft 102 is journaled into the straps 101 and carries a pair of spaced-apart side plates 103. Loosely journaled into the side plates 103 at spaced-apart points around the periphery thereof is a set of twelve rods 104. The sheet steel 12 exits the inlet tube 80, passes around the idler roll mechanism in contact with a number of the rods 104, and up through the outlet tube 85.

Referring to FIGS. 2 and 7, the apparatus 10 further comprises a chromium container 110 which includes a core 111 to which is secured a pair of spaced upper plates 112 attached to an annular side wall 113 by inner and outer retaining rings 114, thereby defining a compartment 115. Lower plates 116 are also attached to the core 111 at a lower region thereon. The plates 116 are attached to an annular side wall 117 by means of inner and outer retaining rings 114, thereby defining a second compartment 119. A side wall 120 secured to the lower upper plate 112 and the upper lower plate 116 defines, with a spacer 121, a third compartment 122. Particulate chromium, which may be either in elemental form or compound form, is contained in one or more of the compartments 115, 119 and 122. Actually each of the plates 112 and 116 includes a screen of a gauge to prevent the particulate chromium from escaping into the lead bath 26, except to the extent it is in solution with the molten lead. Preferably each such plate also includes a sheet of expanded metal or the like to rigidify the associated screen.

The chromium, whether in elemental or compound form, is likely to be contaminated. The contamination can be reduced to some extent by cleaning the chromium prior to placing it in the chromium container 110. Acids and solvents can be useful for this purpose. Also, screening the chromium is of some value in removing debris. Even with screening and/or cleaning, some contamination of the chromium will remain. In solution, such contaminants migrate upwardly and create a dross floating on the lead. Debris from such dross tends to become attached to the sheet steel as it enters the bath 26.

To prevent that from occurring, debris blocking structure is provided which, in the embodiment depicted is a cylindrical tube 125 extending from the cover 50 downwardly into the molten lead 26, terminating in a downwardly and inwardly directed deflector 126 defining a discharge area 127. The upper end of the tube 125 is connected to a cover plate 128 which in turn is connected to the main cover plate 50. Slots 129 accommodate gas flow between the tube 125 and the retort 24. When debris separates from the chromium, it migrates upwardly through the vertical region defined in the tube 125 and floats on the molten lead contained therein. The contaminants do not float on the surface of the balance of the lead which defines another vertical region. Thus, the contaminants do not come in contact with the sheet steel as it enters the lead in the tube 80.

The chromium container 110 is agitated to hasten the dissolution of the chromium in the molten lead. The dissolved chromium is pumped downwardly against the deflector 126 and out the discharge area 127 into the main body of molten lead. The agitator 130 includes an axial bearing 135 attached to the cover plate 128. A stand-off tube 136 is attached at its lower end to the bearing 135 and has opposed elongated slots 137 in its side wall. A shaft 138 is axially movable in the bearing 135, having its lower end attached to the core 111 and partly located within the stand-off tube 136. The upper end of the shaft 138 is coupled by way of a connector 139 to a pneumatically operated cylinder 140. At the joint between the shaft 138 and the connector 139 is a laterally extending pin that rides in the slots 137 for limiting the stroke of the cylinder 140.

Preferably the cylinder 140 operates more slowly in the upstroke than in the downstroke so as forcefully to discharge the molten lead having the entrained chromium therein.

To minimize heat loss from the molten lead, there is provided an insulator 145 hanging by means of chains 146 attached to lugs 147 and to the plate 128. Although the insulator 145 is shown above the insulation plug 90, it is preferable that the insulator 145 be lowered so that it is at the same height, so that a substantially continuous heat shield across the reactor is defined.

A second chromium container 110, a second tube 125, a second agitator 130, and a second insulator 145 are provided as shown.

Before the sheet steel is processed in the lead bath 26, one or more pretreatment steps are required. It is desirable that as many as possible of these pretreatment steps be performed in the line represented by the apparatus 10. Two such steps preferably performed in the line and specifically within the tube 80 are cleaning and decarburizing the sheet steel. A further important step is preheating the steel gradually.

Referring to this last step first, the sheet steel for processing is at room temperature while the bath 26 is at a temperature of between 1,700° F. and 2,300° F. It would be deleterious to the steel to plunge it directly into the bath 26. The temperature of the interior of the tube 80 follows a gradient from the temperature of the bath at its lower end to approximately 500° just below the sealing rolls 64. The time during which the sheet steel is preheated is controlled by its speed through the apparatus 10. A slower speed means that the sheet steel will be treated more slowly as, of course, will its treatment in the bath 26.

The tube 85 being between the molten lead and the cover 50 constitutes a cooling zone containing an atmosphere administered through any one or more of the pipes 86*a, b* and *c*. The atmosphere may be the same as that in the tube 80, at a temperature of say 1,000° F. or lower, to produce rapid cooling.

In order to attain the requisite corrosion resistance, the carbon in the steel must be "tied up" by a strong carbide former like titanium. Accordingly, when the substrate does not itself contain titanium, titanium is codiffused with the chromium in the lead bath. Then, specialized, expensive steel having titanium as part of the alloy is not required. The requisite corrosion resistance was achieved using baths containing 140 ppm titanium and 280 ppm titanium. The minimum titanium level is a function not only of the residual carbon in the steel but also the gradient of the carbon across its thickness. Other factors which affect the quantity of titanium required are the temperature of the bath and the rate at which the steel is cooled after the diffusion process.

The first step is to decarburize the steel to remove a substantial portion of the carbon in the region of its surfaces. The decarburization leaves substantially no carbon at the surface and a carbon content which increases inwardly. In the zone in which the diffusion of chromium is to take place, that is, about 0.2 to 2 mils, a completely carbon free zone is desired. The titanium diffuses into the surfaces of the sheet steel at a rate equal to or exceeding the rate of diffusion of the chromium. The titanium converts the carbon into carbides in the reaction zone.

In an operating form of the invention, the line speed of the sheet steel was adjustable between one inch per minute and 25 inches per minute with a drive torque of 340 inch pounds. The height of the molten lead bath 26 was between 20 inches and 24 inches. The balance of the retort 24 was devoted to preheating the sheet steel. The distance between the bottom of the retort 24 and the insulation plug 90 was 62¾ inches, so that with a 20 inch lead level, the sheet steel was preheated for 42¾ inches while for a 24 inch level the preheat length was 38¾ inches. The center of rotation of the idler roll mechanism 100 was 10 inches off the floor of the retort 24, and its diameter was 6 inches. Thus, if the level of the lead was 20 inches, the sheet steel would be in the bath for 38 inches (10" down+10" up+6) whereas for a 24 inch lead level, the sheet steel was in the bath for 46 inches (14"+14"+6). To be in the bath for two minutes, the line speed would be 19 inches per minute, for a lead level of 20 inches (38"/2 minutes) and 23 inches per minute for a 24 inch level. In order that the sheet steel be in the bath for five minutes, the line speed would be 7.6 inches per minute (38"/5 minutes) or 9.2 inches per minute for a 24 inch lead level.

The sheet steel would be preheated for five minutes if the speed was 8.5 inches per minute using a 20 inch lead level, or 7.5 inches per minute using a 24 inch lead level. It would be preheated for ten minutes if the line speed was 4.3 inches per minute using a 20 inch level or 3.8 inches per minute using a 24 inch lead level.

A decarburizing atmosphere is preferably delivered to the tube 80 at the intermediate points, that is, the pipes 81*c*, where the temperature is high. Gases, such as hydrogen and chlorine, to remove oxides from the sheet steel may be delivered via the pipes 81*a*. A small water vapor content may be used to effect surface and bulk decarburization. A protective gas to keep air away may be delivered via the pipes 81*b*, such protective gas may be 90% argon and 10% hydrogen. Their function is a reducing agent to clean the surface of the sheet steel. The gases are continually exhausted by way of the pipe in order to control pressure in the tube 80. The seal rolls 64 are protected from the hot exhaust gases.

A number of experiments were made in which the continuous processing concept embodied in the apparatus 10 was simulated. In such simulation, the sheet steel was processed by pretreating specimens and then placing them in a molten lead bath rather than continuously moving the sheet steel through the bath. In the following examples, "CQ-2" signifies commercial quality steel, 70 mils in thickness, made by Inland Steel by a hot rolled process; "TBB-2" signifies top and bottom blown sheet steel, 26 mils in thickness, made by Jones & Laughlin by a cold rolled process; "TBB-3" signifies top and bottom blown steel, 86 mils in thickness, made by Jones & Laughlin also by a hot roll process; and "TBB-4" signifies top and bottom blown sheet steel 33 mils in thickness made by Jones & Laughlin by a cold rolled process. The decarburizing step involved placing the sample in an atmosphere of 90% argon by weight and 10% hydrogen, with a dew point of +40° F. The temperature of the atmosphere was 1,550° F. An atmosphere with a higher or lower temperature would perform satisfactorily in such decarburization step. The samples were decarburized for the specified times. Then the samples were left for the specified times in a molten lead bath containing chromium, having the specified temperatures. The specimens made in accordance with the following showed no evidence of rusting in 200 hour salt spray tests:

| Substrate | Decarb. Time (min.) | Time in Bath (min.) | Bath Temp (°F.) |
|---|---|---|---|
| CQ-2 | 30 | 5 | 2000 |
| CQ-2 | 20 | 5 | 2000 |
| CQ-2 | 10 | 5 | 2000 |
| TBB-3 | 20 | 5 | 2000 |
| TBB-3 | 20 | 5 | 2000 |
| TBB-3 | 10 | 5 | 2000 |

-continued

| Substrate | Decarb. Time (min.) | Time in Bath (min.) | Bath Temp (°F.) |
|---|---|---|---|
| TBB-3 | 10 | 5 | 2000 |
| TBB-2 | 10 | 5 | 2000 |
| TBB-2 | 5 | 5 | 2000 |
| TBB-2 | 5 | 5 | 2000 |
| TBB-4 | 10 | 5 | 2000 |
| TBB-4 | 10 | 5 | 2000 |
| TBB-4 | 10 | 5 | 2100 |
| TBB-4 | 10 | 5 | 2100 |
| TBB-4 | 10 | 5 | 2100 |
| TBB-3 | 10 | 5 | 2000 |
| TBB-3 | 10 | 5 | 2000 |

Cyclic oxidation tests were conducted on specimens made in accordance with the foregoing process under various conditions. These tests were run for 96 cycles, with each cycle consisting of a 55 minute exposure at 1,450° F. followed by a 5 minute forced air cool room temperature. The specimens were weighed before and after the test and weight gains per unit area were determined. For the following specimens, the weight gain per unit area was less than 0.63 mg/cm$^2$, which is the weight gain per unit area of 409 stainless steel under similar conditions:

| Substrate | Decarb. Time (min.) | Time in Bath (min.) | Bath Temp (°F.) | Weight Gain (mg/cm$^2$) |
|---|---|---|---|---|
| CQ-2 | 30 | 5 | 2000 | 0.26 |
| CQ-2 | 20 | 5 | 2000 | 0.28 |
| TBB-3 | 20 | 5 | 2000 | 0.45 |
| TBB-3 | 10 | 5 | 2000 | 0.36 |
| TBB-2 | 10 | 5 | 2000 | 0.59 |
| TBB-2 | 5 | 5 | 2000 | 0.61 |
| TBB-4 | 10 | 5 | 2000 | 0.62 |
| TBB-3 | 10 | 5 | 2000 | 0.34 |

A series of experiments were run in sealed capsules to determine the influence of titanium bath content on the formability of sheet metal samples that were co-alloyed with chromium in a short cycle process. All experiments were carried out in 2-inch diameter steel tubes that were evacuated and sealed. Each tube contained 1500 grams of lead, 10 grams of elemental vacuum grade chromium and commercially pure titanium in amounts varying from 0.1 to 1.0 grams. Four steel samples having dimensions of 1.5"×2"×0.30" and having an 0.125" diameter hole drilled at each end were strung on top and bottom support wires inside the 2" diameter tubes. Twisted wire spacers were placed over the support wires between each sample to provide separations. The substrate that was evaluated was an aluminum killed steel that was decarburized at 1450° F. in an Ar-10 v/o $H_2$ atmosphere with a dew point of +40° F. to produce a bulk carbon content of 0.005 w/o.

The sealed tubes were placed in a furnace at 2100° F. and were shaken vigorously after attaining a temperature at which all of the lead was molten. The vigorous shaking was continued until the tubes reached 2100° F. and for 10 minutes at that temperature. The tubes were then removed and air cooled. A series of runs were made in which the titanium bath additions were as follows:

| Ti bath Addition (grams) | Ti Concentration in Lead Bath (ppm) |
|---|---|
| 0 | 0 |
| 0.1 | 67 |
| 0.25 | 167 |
| 0.35 | 233 |
| 0.40 | 267 |
| 0.45 | 300 |
| 0.50 | 333 |
| 0.55 | 367 |
| 0.75 | 500 |
| 1.0 | 667 |

Surface composition analyses were made on the diffusion alloyed steels using standard energy dispersive spectroscopy microprobe procedures at an accelerating voltage of 25 KV. The surface chromium contents varied from 43.4 to 36.2 w/o while the surface titanium concentration increased to 2.4 w/o for the 667 ppm titanium bath concentration run. Examination of metallographically polished cross-sections that were etched with 5% Nitol showed that the thickness of the diffusion layer increased from 30 microns with no titanium bath addition to 92 microns with a 667 ppm titanium bath concentration. Microhardness measurements made with a diamond pyramid indenter at a load of 15 grams show that the hardness at a depth of about 10 microns from the surface increases with increasing bath titanium content from a value of 150 DPN with no titanium bath addition to a value of 235 DPN with a 667 ppm titanium bath concentration.

Bend tests were run on 0.5 inch wide ×1 inch long samples that were bent 180° around an 0.060 inch thick sheet (2T bend). The tension side of the bend surfaces was examined with a scanning electron microscope at a magnification of 1000×. Specimens that were produced in baths containing up to 267 ppm titanium showed no evidence of surface cracking. The grains on the surface showed slip lines that were approximately parallel to the bend axis. The specimen produced at a bath concentration of 300 ppm titanium showed very fine intergranular cracks that generally ran in a direction parallel to the bend axis. Examination of the cross section of these cracks showed that they do not extend more than 5 microns in from the surface. Salt spray tests performed in accordance with ASTM B117 for 16 hours showed no evidence of rusting in these microcracked areas.

The specimen produced at a bath concentration of 333 ppm titanium showed intergranular cracking that was more extensive than that in the 300 ppm titanium bath concentration run. Salt spray testing as performed above again showed no evidence of rusting in the microcracked areas.

The specimen produced at a bath concentration of 367 ppm titanium showed very extensive microcracking with fissures formed that extend well into the diffusion layer. Salt spray testing showed that rusting occurred at the bottom of the largest of these fissures. The specimens produced at even higher titanium bath concentrations showed more extensive intergranular cracking with more deep fissures formed. Thus it has been determined that to have a usable sheet metal product having good formability and the ability to maintain corrosion resistance in formed areas it is necessary to restrict the titanium bath concentration to a value of less than 367 ppm. This will also result in the formation of a surface alloy having less than 1 w/o Ti as a surface concentration and a cross-sectional microhardness at 10 microns from the surface of less than 200 DPN when these measurements are made by the methods described.

In certain instances, the chromium delivered by the chromium container 110 alone is not sufficient. Three additional chromium containers 150 provide a system for additional delivery of chromium. The containers are rectangular in plan, and are horizontally arranged and vertically spaced apart. The containers are attached to four brackets 151 arranged in a rectangle (two are shown in FIG. 2), the brackets being hung from a pair of cross bars 152. Each of the containers 150 includes a rectangular spacer 153, a pair of rectangular screens 154 and a pair of rectangular retaining rings 155. The space between the screens 154 and the spacer 153 is a compartment 156 within which chromium is placed. Each of the screens 154 consists of a fine wire mesh with a sheet of perforated metal on either side to define a relatively rigid sandwich. In an actual embodiment, each of the containers 150 had dimensions of 9"×15"×1" and contained about 10 pounds of chromium. This addition to the system increased the attainable surface chromium composition on the steel sheet to 24 w/o.

Immediately beneath the stack of three containers 150 is a length of tubing 160 that has a series of spaced perforations (not shown) through which a dry gas (inert or reducing) is passed. The gas exits through the perforations and percolates through the stacked chromium containers 150, providing agitation and increasing the solution of chromium in the molten lead.

To further facilitate chromium diffusion, two gas tubes 170 are mounted on the inlet tube 80 adjacent its exit end. The tubes 170 are located respectively on the sides of the steel sheet 12. These tubes are perforated at the top. Gas delivered to the tubes 170 by means of tubing 171 is discharged through the perforations and bubbles into the tube 80, thereby agitating the molten lead at the surfaces of the steel sheet.

The combination of the tube 170 next to the strip entry tube 80 and the tube 160 beneath the containers 150 causes the surface chromium concentration to increase. In a particular embodiment the concentration increased to 33 w/o.

What has been described therefore is an improved process and apparatus for diffusing chromium into the surfaces of steel products in coil form. In the specific embodiment, sheet steel is the product. However, the same principles are applicable to foil, plate and wire that are supplied in coil form. Also, while titanium is the preferred additive to the bath, other strong carbide formers could be employed. Furthermore, while a particular apparatus has been described as being capable of practicing the process, it is contemplated that substantial changes would be made in equipment that would perform the process on a commercial scale.

We claim:

1. A continuous process of surface diffusion alloying a continuous length of steel product supplied in a coil, comprising uncoiling the steel product, preheating the steel product, providing a molten-alloy bath having therein lead and chromium and titanium, said molten-alloy bath having titanium of a concentration in the range of about 67 ppm to about 367 ppm, lead being the only transfer agent in the bath, moving the steel product continuously through the bath for diffusing the chromium into the surface of the steel product, and cooling the diffused steel product.

2. The process of claim 1, wherein about 140 ppm titanium is in the bath.

3. The process of claim 1, wherein about 280 ppm titanium is in the bath.

4. The process of claim 1, wherein the steel product is first decarburized prior to insertion into the bath.

5. The process of claim 1, wherein the steel product is sheet steel.

6. The process of claim 1, wherein the uncoiled steel product is preheated.

7. The process of claim 1, wherein the steel product is coiled after having been cooled.

8. The process of claim 1, wherein the temperature of the bath is between 1,700° F. and 2,300° F.

9. The process of claim 1, wherein the temperature of the bath is about 2,000° F.

10. The process of claim 1, wherein the temperature of the bath is about 2,100° F.

* * * * *